US005094088A

United States Patent [19]

Davis

[11] Patent Number: 5,094,088

[45] Date of Patent: Mar. 10, 1992

[54] BEVERAGE STORAGE AND COOLING SYSTEM

[76] Inventor: Brian Davis, 20 Gibson Ave., Werrington, New South Wales, Australia

[21] Appl. No.: 442,352

[22] PCT Filed: Mar. 1, 1989

[86] PCT No.: PCT/AU89/00082

§ 371 Date: Dec. 28, 1989

§ 102(e) Date: Dec. 28, 1989

[87] PCT Pub. No.: WO89/08074

PCT Pub. Date: Sep. 8, 1989

[51] Int. Cl.[5] ..... B67D 5/62

[52] U.S. Cl. ..... 62/393; 62/436; 165/164

[58] Field of Search ..... 165/164; 62/393, 430, 62/434, 436, 439

[56] References Cited

U.S. PATENT DOCUMENTS

| | | | |
|---|---|---|---|
| 1,794,483 | 3/1931 | Shepherd | 62/439 |
| 2,106,263 | 1/1938 | Winter | 62/439 X |
| 3,269,422 | 8/1966 | Matthews et al. | 165/164 X |
| 3,681,936 | 8/1972 | Park | 62/434 X |
| 4,194,536 | 3/1980 | Stine et al. | 165/164 X |
| 4,523,637 | 6/1985 | Abramo | 165/164 X |
| 4,676,400 | 6/1987 | Lamont et al. | 62/393 X |

*Primary Examiner*—William E. Tapolcai
*Attorney, Agent, or Firm*—Morrison & Foerster

[57] ABSTRACT

A python for maintaining the drinking liquid flowing in lines therein at a predetermined temperature has a drinking liquid delivery line adapted to deliver drinking liquid, coolant tubes adapted to carry coolant and insulator tubing arranged in that order concentrically outwardly. The central drinking liquid delivery line consists of a central drinking liquid tube surrounded by secondary drinking liquid tubes. The central drinking liquid delivery line is in thermal contact with and surrounded by the coolant tubes. The coolant tubes are surrounded by insulator tubing in such a way as to restrict the free movement of both the drinking liquid delivery line and coolant tubes. The drinking liquid is thereby maintained at a predetermined temperature by the temperature of the coolant and the effect of the above-mentioned concentric arrangement of drinking liquid delivery line, coolant tubes and insulator tubing.

6 Claims, 1 Drawing Sheet

BEVERAGE STORAGE AND COOLING SYSTEM

FIELD OF INVENTION

This invention relates to beverage storage and cooling systems, and more particularly to a means for maintaining drinking liquid at a constant temperature during passage of such liquid through commerical beverage delivery lines.

This invention finds preferred application in beverage storage and cooling systems commonly employed in Hotels, Clubs and Restaurants.

Background Art

Conventionally, whenever refrigerated drinking liquid is fed through delivery lines to a dispense point of a bar of a Hotel, Club or Restaurant, the drinking liquid delivery lines are run in close proximity to coolant lines arranged randomly with the drinking liquid delivery lines. The coolant lines circulate liquid coolant at a temperature sufficient to maintain the temperature of the drinking liquid flowing in the delivery lines at roughly the required temperature. The combined drinking liquid delivery and coolant lines are housed loosely within thick insulator tubing and the product in toto is described in the trade as a python. In most instances however, the contribution of these pythons to maintaining the drinking liquid at the required temperature has had to be supplemented by instantaneous bar coolers which take up valuable bar space and often appear unsightly. Furthermore, the loose configuration of lines of the python facilitates the growth of micro-organisms, and particularly yeast, on the outer surface of these lines. The random arrangement of drinking liquid delivery lines and coolant lines within the insulator tubing leads to low efficiency of cooling of the drinking liquid in the delivery lines.

Clearly, the coolant lines need to be positioned within the insulator tubing so as to maximize the cooling effect of the coolant tubes without waste of space and energy. The desired arrangement of lines should improve thermal efficiency of the beverage storage and cooling system generally, and so eliminate the need for instantaneous bar coolers.

It is an object of the present invention to provide an improved python which will substantially overcome or ameliorate the abovementioned disadvantages of the prior art.

It is a further object of the present invention to provide a python which will maintain the drinking liquid flowing in lines therein at a predetermined temperature.

DISCLOSURE OF THE INVENTION

According to the invention there is provided a python for maintaining the drinking liquid flowing in lines therein at a predetermined temperature, said python comprising:

a) a drinking liquid delivery line, adapted to carry drinking liquid, b) a coolant line positioned about and in thermal contact with the drinking liquid delivery line, said coolant line adapted to carry coolant, c) insulator tubing enclosing both the said drinking liquid delivery line and said coolant line so as to restrict the free movement of the said lines, and wherein the temperature of the coolant flowing through the said coolant line and the abovementioned configuration of the drinking liquid delivery line, coolant line, and insulator tubing is such as to maintain the drinking liquid in the said drinking liquid delivery line at a predetermined temperature.

When the python is to be used for transferring and cooling a large quantity of drinking liquid, as may be required of a beer line linking an ice bank tank to the service bar, the drinking liquid delivery line comprises a central drinking liquid tube and secondary drinking liquid tubes positioned so as to be in mutual contact about and in contact with the circumference of the central drinking liquid tube.

The coolant line may consist of a single tube whose circumference surrounds the drinking liquid delivery line, or it may consist of a plurality of tubes positioned so as to be in mutual contact about and in thermal contact with the drinking liquid delivery line.

When the python is to be used for transferring and cooling a small quantity of drinking liquid, as may be required of a beer riser lead linking the service bar python to the dispensing taps, the drinking liquid delivery line comprises a single drinking liquid tube.

Where a plurality of drinking liquid tubes in the python is required, the circumference of each of the drinking liquid tubes is preferably identical, and can be made of nylon, EVA or stainless steel. Where the python consists of a plurality of coolant tubes, the coolant tubes are preferably of equal circumference, and can be made of nylon or EVA. The circumference of the drinking liquid tubes is preferably the same as that of the coolant tubes. Optionally, where the drinking liquid delivery line comprises a central drinking liquid tube surrounded by secondary drinking liquid tubes, silver foil may be wrapped around the outer surface of the drinking liquid delivery line. PVC or polyester film may wrap around the outer surface of the coolant lines.

The insulator tubing may be of any flexible insulating material that provides a tight fit of the lines within.

BRIEF DESCRIPTION OF THE DRAWINGS

In order that the invention may be more readily understood and put into practical effect, reference will now be made to the accomapnying drawings, in which.

DESCRIPTION OF PREFERRED EMBODIMENT

It will be apparent that the python of the invention may be employed in a number of different beverage storage and cooling systems.

In one beverage storage and cooling system to which the invention may be applied, beer is pumped from its storage keg in the cellar through feed lines to cooling coils submersed in liquid coolant contained in a sealable ice bank tank. The coolant is maintained at a temperature sufficient to chill the beer in the cooling coils to the required temperature. Coolant lines fed by coolant liquid from the ice bank tank, and beer lines fed with beer from the cooling coils converge within the ice bank tank to assume the configuration of lines in the python 10 shown in FIG. 1.

It is an important consequence of the high efficiency of cooling of the python of the invention that the liquid coolant need only be contained in a single chambered ice bank/chiller tank at a storage temperature substantially equivalent to the temperature of the liquid coolant flowing through the coolant lines. Hence, the one predetermined temperature of liquid coolant within the ice bank tank will both chill the beverage and maintain the temperature of the beverage as it passes through the drinking liquid lines.

Figure 1:
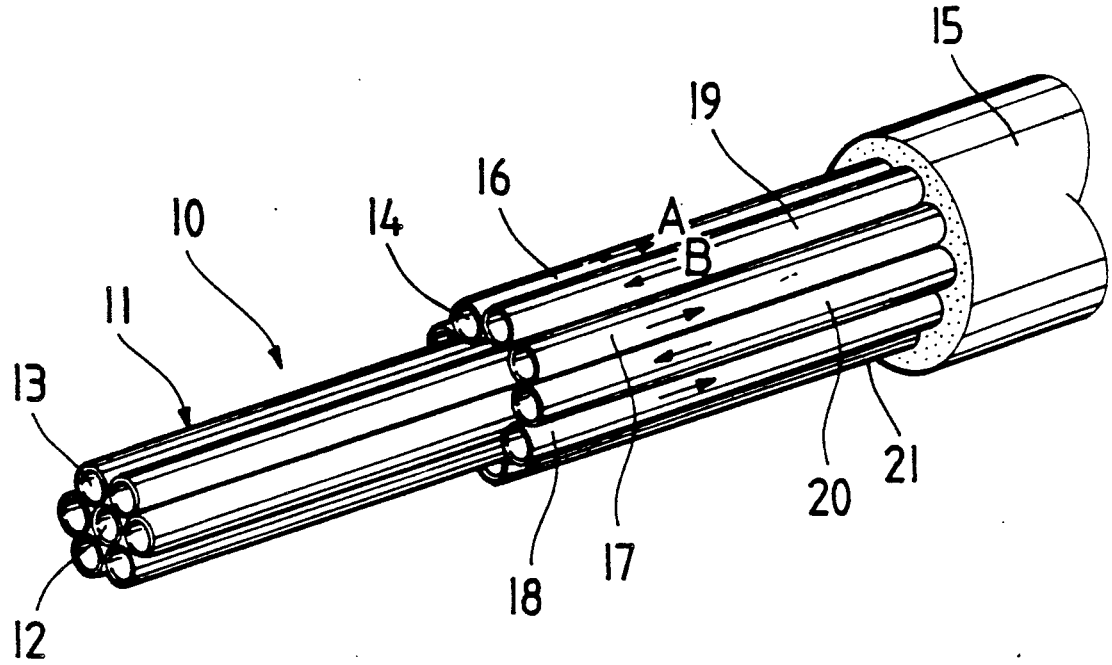
FIG. 1 is a cut-away perspective view of a beer line python according to one embodiment of the invention.

The beer line python 10 of FIG. 1 has a beer delivery line 11 consisting of a central beer tube 12 surrounded by secondary beer tubes 13. The beer delivery line 11 is surrounded by a coolant line 14 which is enclosed by insulator tubing 15.

In operation, beer is pumped through the beer tubes 12 and 13 and is kept at a constant temperature by coolant being pumped through coolant tubes 14. The coolant in any one coolant tube flows in an opposite direction to that of the coolant in an adjacent coolant tube (as shown by arrows A and B in FIG. 1). Coolant flowing towards the ice bank tank flows through alternate coolant return tubes (only 16, 17 and 18 shown), and coolant flowing away from the ice bank tank flows through coolant supply tubes (only 19, 20 and 21 shown).

The configuration of the beer and coolant tubes within the insulator tubing 15 provides that each of the secondary beer tubes 13 is in contact with the largest possible surface area of coolant tubes, so maximizing heat dissipation from the beer line to coolant line.

Figure 2:
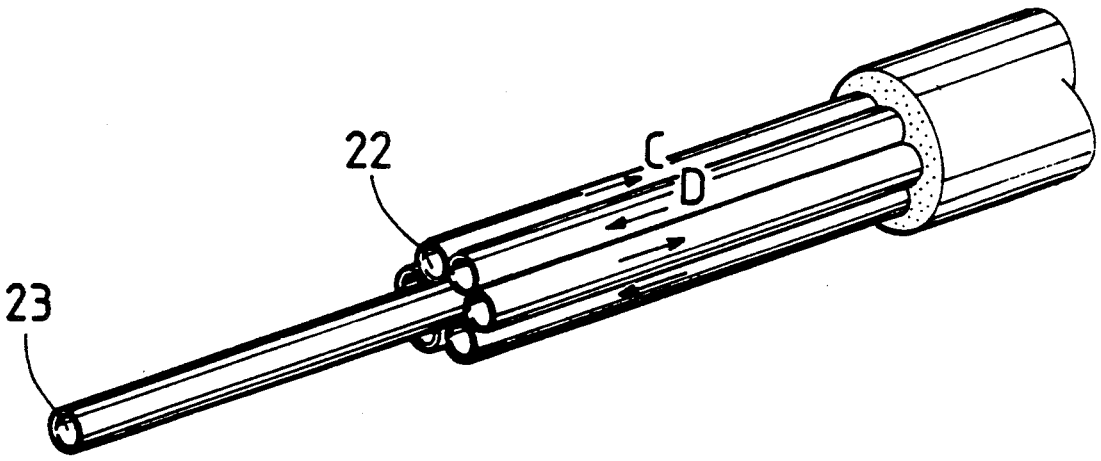
FIG. 2 is a cut-away perspective view of a beer line python according to a second embodiment of the invention.

In order to provide chilled beer to a series of taps at the bar, beer riser leads as shown in FIG. 2 branch off the beer line python of FIG. 1. Where six coolant tubes 22 are required in the beer riser lead, this is achieved by feeding three coolant supply tubes off the beer line python and running them up alongside the beer line 23 to the tap whereupon they bend back to run down alongside the same beer line 23 in the configuration shown in FIG. 2 and then separately feed into the python from which they issued as coolant return tubes. The direction of flow of coolant is indicated by the arrows C and D.

Where the beer line python has seven beer tubes and twelve coolant tubes (as in FIG. 1), then in order to supply beer to seven taps, one coolant supply tube will have two sets of branches to separately supply two taps and the corresponding coolant return tube will be fed at two sites by coolant returning from two separate riser leads.

As will be appreciated by this technique, the recirculation of coolant through tubes running in the abovementioned python configuration from ice bank tank to tap maintains the beverage at the required temperature until it is dispensed from the tap.

Various modifications can be made in details of design and construction without departing from the scope and ambit of the invention.

I claim:

1. A python for maintaining the drinking liquid flowing in lines therein at a predetermined temperature, said python comprising:

a) a drinking liquid delivery line adapted to carry drinking liquid, wherein the drinking liquid delivery line comprises a central drinking liquid tube and secondary drinking liquid tubes postioned so as to be in mutual contact about and in contact with the circumference of the central drinking liquid tube, b) a plurality of coolant tubes aligned with the drinking liquid delivery line and positioned so as to be in mutual contact about and in thermal contact with the drinking liquid delivery line, said coolant tubes adapted to carry coolant, c) insulator tubing enclosing both the said drinking liquid delivery line and said coolant line so as to restrict the free movement of the said line and tubes, and wherein the temperature of the coolant flowing through the said coolant line and the above mentioned configuration of the drinking liquid delivery line, coolant line and insulator tubing are such as to maintain the drinking liquid in the said drinking liquid delivery line at a predetermined temperature.

2. A python according to claim 1, including means for causing the coolant to flow through any one coolant tube in an opposite direction to that of the coolant in an adjacent coolant tube.

3. A python according to claim 1, further including silver foil wrapped around the outer surface of the drinking liquid delivery line.

4. A python according to claim 1, further including a film selected from the group comprising polyvinylchloride or polyester, said film wrapped around the outer surface of the coolant line.

5. A python according to claim 2, further including a film selected from the group comprising polyvinylchloride or polyester, said film wrapped around the outer surface of the coolant line.

6. A python according to claim 3, further including a film selected from the group comprising polyvinylchloride or polyester, said film wrapped around the outer surface of the coolant line.

* * * * *